US007771578B2

(12) United States Patent
Albrecht et al.

(10) Patent No.: US 7,771,578 B2
(45) Date of Patent: Aug. 10, 2010

(54) METHOD FOR PRODUCING OF A GALVANIC COATING

(75) Inventors: Anton Albrecht, Andechs (DE); Thomas Dautl, Weichs (DE); Oemer-Refik Oezcan, Dachau (DE); Horst Pillhoefer, Roehrmoos (DE)

(73) Assignee: MTU Aero Engines GmbH, Munich (DE)

( * ) Notice: Subject to any disclaimer, the term of this patent is extended or adjusted under 35 U.S.C. 154(b) by 843 days.

(21) Appl. No.: 11/579,721

(22) PCT Filed: May 2, 2005

(86) PCT No.: PCT/DE2005/000811

§ 371 (c)(1),
(2), (4) Date: Jan. 24, 2007

(87) PCT Pub. No.: WO2005/108651

PCT Pub. Date: Nov. 17, 2005

(65) Prior Publication Data

US 2008/0035486 A1 Feb. 14, 2008

(30) Foreign Application Priority Data

May 4, 2004 (DE) ..... 10 2004 021 926

(51) Int. Cl.

| | |
|---|---|
| ***C25D 5/08*** | (2006.01) |
| ***C25D 5/18*** | (2006.01) |
| ***C25D 3/50*** | (2006.01) |
| ***C25D 17/12*** | (2006.01) |
| ***C23C 28/02*** | (2006.01) |
| ***C23C 10/48*** | (2006.01) |

(52) U.S. Cl. ..... 205/96; 204/284; 205/97; 205/102; 205/148; 205/191; 205/208; 205/228; 205/264

(58) Field of Classification Search ..... 205/96, 205/97, 102, 148, 191, 208
See application file for complete search history.

(56) References Cited

U.S. PATENT DOCUMENTS 3,666,638 A 5/1972 Harris et al.

(Continued)

FOREIGN PATENT DOCUMENTS

EP 0 718 420 6/1996

(Continued)

OTHER PUBLICATIONS

Masaharu Kaibe et al., "Anodization of Aluminum Alloys in Phosphoric Acid-Sulfuric Acid-Water Systems", Aruminyumu Hyomen Shori Kenkyu Chosa Hokoku (no month, 1974), vol. 86, pp. 65-66, with English abstract.

*Primary Examiner*—Patrick Ryan
*Assistant Examiner*—William T Leader
(74) *Attorney, Agent, or Firm*—W. F. Fasse; W. G. Fasse

(57) ABSTRACT

In a method for production of a corrosion resistant and/or oxidation resistant coating, at least one metal of the platinum group or an alloy thereof is galvanically deposited onto a surface of a substrate, and thereafter the thusly galvanically coated substrate is aluminized. In a first stage of the galvanic deposition process a current magnitude applied for the galvanizing is increased continuously or step-wise beginning from an initial value up to a maximum value, and in a second stage of the galvanic deposition process the current magnitude applied for the galvanizing is maintained constant at the maximum value. The galvanic deposition of the or each metal of the platinum group or the corresponding alloy may be carried out using an open-celled or open-mesh or porous anode.

16 Claims, 3 Drawing Sheets

U.S. PATENT DOCUMENTS

| | | | | |
|---|---|---|---|---|
| 4,085,012 | A | 4/1978 | Marceau et al. | |
| 4,172,773 | A * | 10/1979 | Pellegri et al. | 205/743 |
| 4,894,127 | A | 1/1990 | Wong et al. | |
| 5,415,761 | A | 5/1995 | Muell | |
| 5,482,578 | A | 1/1996 | Rose et al. | |
| 5,486,283 | A | 1/1996 | Mnich | |
| 6,066,405 | A * | 5/2000 | Schaeffer | 428/547 |
| 6,324,978 | B1 * | 12/2001 | Kaulen et al. | 101/459 |
| 6,432,821 | B1 * | 8/2002 | Dubin et al. | 438/678 |
| 6,974,531 | B2 * | 12/2005 | Andricacos et al. | 205/102 |
| 7,083,827 | B2 | 8/2006 | Schaeffer | |
| 2005/0150771 | A1 | 7/2005 | Kock et al. | |
| 2007/0134095 | A1 | 6/2007 | Kliewe | |

FOREIGN PATENT DOCUMENTS

| | | |
|---|---|---|
| EP | 0 784 104 | 7/1997 |
| EP | 1 076 116 | 2/2001 |
| EP | 1 094 131 | 4/2001 |
| EP | 1 233 084 | 8/2002 |
| GB | 1 555 940 | 11/1979 |
| WO | WO 03/088316 | 10/2003 |

* cited by examiner

10

11

12

METHOD FOR PRODUCING OF A GALVANIC COATING

FIELD OF THE INVENTION

The invention relates to a method for production of a corrosion resistant and/or oxidation resistant coating. Furthermore, the invention relates to an anode for use in a method for production of a corrosion resistant and/or oxidation resistant coating.

BACKGROUND OF THE INVENTION

In the operation of components, especially components of gas turbines, at high temperatures, their free surfaces are exposed to strongly corrosive and oxidative conditions. In the application in gas turbines, such components can, for example, consist of a super-alloy on a nickel basis or a cobalt basis. The components are provided with coatings for protection against corrosion, oxidation or also erosion. PtAl coatings are preferred, with which an especially good corrosion protection and/or oxidation protection can be realized.

The EP 0 784 104 B1 discloses a PtAl coating for gas turbine components as well as a method for production of such a coating. According to the method described there, a PtAl coating is produced on a substrate in that a platinum layer is deposited on a substrate surface, whereby a diffusing of platinum from the platinum layer into the substrate surface is carried out after the deposition of the platinum layer. After the deposition of the platinum layer and the in-diffusion of the platinum, the thusly coated substrate is alitized or aluminized, i.e. coated with aluminum, whereby the aluminum is preferably diffused into the substrate surface.

The deposition of platinum onto the substrate surface before the aluminizing of the substrate preferably occurs in a galvanic manner. The present invention relates to details of a method for production of a corrosion resistant and/or oxidation resistant coating on a substrate, which relate to the galvanic deposition of a metal of the platinum group, in particular of platinum and/or palladium, or an alloy based on at least one metal of the platinum group. Thus, it is of significant importance for the quality of the corrosion resistant and/or oxidation resistant coating, that a uniformly defined deposition of particularly platinum is realized in a galvanic manner, in order to thereby realize a uniform thickness of a platinum coating. Thus, for example, the coating thickness may not undershoot or fall below a minimum value of the coating thickness of approximately 1 μm, because this would give rise to an inadequate hot gas resistance and a local rapid failure of the coating. On the other hand, layer thicknesses of 8 to 15 μm may not be exceeded, because hereby on the one hand valuable precious metal would be wasted and on the other hand the characteristics of the coating would be made worse. A further problem of galvanic deposition of particularly platinum on a substrate exists when the platinum, for example, is to be deposited onto structural components with a complex three-dimensional configuration. Such substrates with a complex three-dimensional contour, are, for example, gas turbine vanes or blades, because these on the one hand are strongly unsymmetrical, and on the other hand comprise edges, corners and surfaces having points as well as hollow spaces and undercuts. A uniformly defined deposition of platinum on substrates with a complex three-dimensional contour can only be inadequately realized with the methods known from the state of the art for the galvanic deposition of platinum.

SUMMARY OF THE INVENTION

Beginning from the above, the problem underlying the present invention is to provide a novel method for production of a corrosion resistant and/or oxidation resistant coating.

This problem is solved by a method for production of a corrosion resistant and/or oxidation resistant coating in which, according to a first aspect of the invention, the galvanic deposition of the or each metal of the platinum group or the corresponding alloy is carried out in an at least two-staged deposition process, whereby in a first stage of the deposition process a current magnitude applied for the galvanizing is increased continuously or step-wise beginning from an initial value up to a maximum value, and whereby in a second stage of the deposition process the current magnitude applied for the galvanizing is held constant at the maximum value.

Furthermore, this problem is solved by a method for production of a corrosion resistant and/or oxidation resistant coating in which, according to a second aspect of the invention, the galvanic deposition of the or each metal of the platinum group or the corresponding alloy is carried out while using at least one open-celled or open-mesh or porous anode, whereby a relative motion is established between, on the one hand, a galvanic bath and, on the other hand, the substrate as well as the or each open-celled or open-mesh or porous anode during the galvanic deposition.

An embodiment of the inventive method in which both of the above aspects are combined with one another is especially preferred.

Preferred further developments of the invention arise from the dependent claims and the following description. Example embodiments of the invention are explained in further detail in connection with the drawings, without being limited hereto.

DETAILED DESCRIPTION OF EXAMPLE EMBODIMENTS OF THE INVENTION

Figure 1:
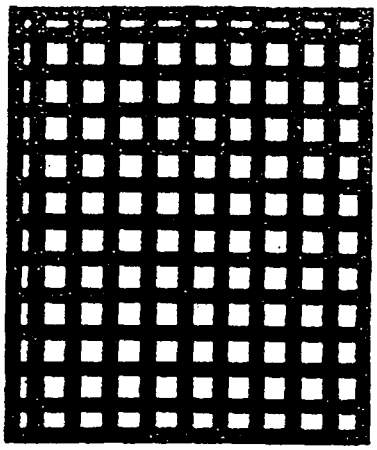
FIG. 1 a strongly schematized illustration of an inventive anode according to a first example embodiment for use in the inventive method.

In the following, the inventive method for production of a corrosion resistant and/or oxidation resistant coating, preferably a PtAl coating, will be described in greater detail.

In that regard, the present invention especially relates to such details that relate to the galvanic deposition of at least one metal of the platinum group, in particular of platinum and/or palladium, or an alloy based on at least one metal of the platinum group, onto a substrate that is to be coated. At this point, it is pointed out that a diffusion of the platinum and/or palladium or the corresponding alloy into the substrate can take place after the galvanic deposition of platinum and/or palladium or an associated pertinent alloy onto the substrate and before the aluminizing of the thusly galvanically coated substrate.

A surface pre-treatment of the substrate occurs before the actual galvanic deposition of the or each metal of the platinum group or the corresponding alloy. The surface pre-treatment of the substrate encompasses at least the following three steps: In a first step of the surface pre-treatment, the surface of the substrate to be coated is jet blasted. The jet blasting occurs with $Al_2O_3$ particles, which comprise a particle diameter of 100 to 200 μm and are directed with a pressure with 1.5 to 3.5 bar onto the substrate surface that is to be jet blasted. During the jet blasting, the work is carried out with a degree of overlap from 200 to 1500%, which means that each surface section is jet blasted between 2 and 15 times or is acted on by a corresponding number of particle jets. After the jet blasting, a metallic bare as well as oxide-free substrate surface exists. Following the jet blasting, the jet-blasted surface is electrochemically cleaned or degreased, namely in a NaOH-containing solution.

Following the degreasing or cleaning of the substrate surface, an activation thereof occurs in a 40 to 60 vol. % HCl solution.

Following the surface pre-treatment of the substrate, the galvanic deposition of the or each metal of the platinum group or of the corresponding alloy occurs with the aid of a deposition process. According to a first aspect of the present invention, the galvanic deposition occurs in an at least two-staged deposition process, whereby in a first stage of the deposition process a current magnitude applied for the galvanizing is increased continuously or step-wise beginning from an initial value up to a maximum value, and whereby in a second stage of the deposition process the current magnitude applied for the galvanizing is held constant at the maximum value.

In that regard, the galvanic deposition is carried out over a total coating time T whereby the first stage of the deposition process, in which the current magnitude applied for the galvanizing is increased continuously or step-wise beginning from the initial value up to the maximum value, occurs in a coating time $T_1$, and whereby the second stage of the deposition process, in which the current magnitude applied for the galvanizing is held constant at the maximum value, is carried out in a coating time $T_2$. The coating time $T_1$ of the first stage of the deposition process in that regard amounts to approximately 50% of the total coating time, the coating time $T_2$ of the second stage of the deposition process similarly amounts to approximately 50% of the total coating time T. Accordingly, it then pertains for the total coating time T: $T=T_1+T_2$.

According to a first preferred further development of this first aspect of the present invention, the current magnitude I is increased continuously beginning from an initial value, which corresponds to approximately 10% of the maximum value $I_{max}$ of the current magnitude applied for the galvanizing, up to the maximum value within the coating time $T_1$. Alternatively to this, the current magnitude I in the coating time $T_1$ can be increased step-wise beginning from this initial value up to the maximum value $I_{max}$. After reaching this maximum value $I_{max}$, in each case the current magnitude I applied for the galvanic deposition is maintained at this maximum value $I_{max}$ during the second stage of the deposition process.

In especially preferred example embodiments, in which the coating time $T_1$ of the first stage as well as the coating time $T_2$ of the second stage amount to respectively 50% of the total coating time T, and in which the initial value of the current magnitude I in the first stage of the deposition process amounts to 10% of the maximum current magnitude $I_{max}$, preferably one of the following conditions applies to the current I applied for the galvanic deposition, whereby the condition (1) corresponds to the continuous increasing of the current I in the first phase of the deposition process, and whereby the condition (2) corresponds to the step-wise increasing of the current I during the first phase of the deposition process.

$$I = \begin{cases} 0.1 * I_{MAX} + \dfrac{0.9 * I_{MAX}}{0.5 * T} * t & \text{for } 0 \le t \le 0.5 * T \\ I_{MAX} & \text{for } 0.5 * T \le t \le T \end{cases} \tag{1}$$

$$I = \begin{cases} 0.1 * I_{MAX} & \text{for } 0 \le t < 0.1 * T \\ 0.4 * I_{MAX} & \text{for } 0.1 * T \le t < 0.3 * T \\ 0.7 * I_{MAX} & \text{for } 0.3 * T \le t < 0.5 * T \\ I_{MAX} & \text{for } 0.5 * T \le t \le T \end{cases} \tag{2}$$

At this point it is pointed out that the maximum current $I_{max}$ applied for the galvanic deposition corresponds to an order of magnitude from 0.2 to 3.5 A/dm$^2$ depending of the type of galvanic bath being utilized, preferably one operates with maximum currents of 1.5 A/dm$^2$ or 2 A/dm$^2$. Although, in the above example embodiment, one operates with an initial value of the current magnitude I that amounts to approximately 10% of the maximum current magnitude $I_{max}$, one can also operate with an initial value of the current magnitude I that amounts to approximately 15% or also 20% of the maximum current magnitude $I_{max}$.

In the sense of the present invention, the substrate to be coated is circuit-connected cathodically and thus negatively during the entire deposition process, thus during the entire first stage and the entire second stage of the deposition process. In the sense of the present invention, before the actual deposition process, the substrate that is to be coated can be anodically i.e. positively circuit-connected and thusly introduced into the galvanic bath. Alternatively it is also possible to directly cathodically circuit-connect the substrate to be coated.

According to a further aspect of the present invention, the galvanic deposition of the or each metal of the platinum group or the corresponding alloy is carried out while using at least one open-celled or open-mesh or porous anode, whereby a relative motion is established between, on the one hand, the galvanic bath and, on the other hand, the substrate to be coated and the or each anode, during the galvanic deposition, thus during the first phase and the second phase of the deposition process.

FIGS. 1 to 5 show five different anodes 10, 11, 12, 13 and 14, which are all embodied porously or open-celled or open-meshed in the sense of the present invention. The anodes 10 to 14 differ from one another with respect to the form of the perforation openings and with respect to the degree of perforation. The open-celled or open-mesh or porous anodes in that regard comprise a perforation degree between 20% and 80%. The opening size or width of the perforation openings amounts to between 1 and 10 mm.

Figure 2:
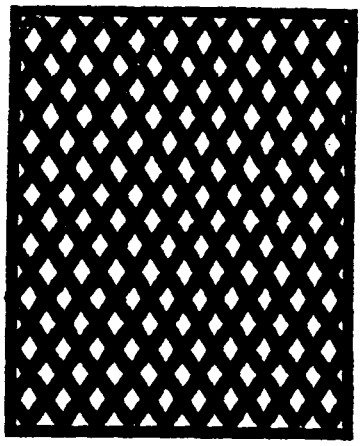
FIG. 2 a strongly schematized illustration of an inventive anode according to a second example embodiment for use in the inventive method.
Figure 3:
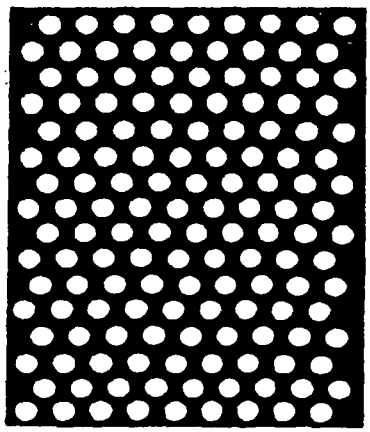
FIG. 3 a strongly schematized illustration of an inventive anode according to a third example embodiment for use in the inventive method.

Thus, FIGS. 1 to 3 all show inventive anodes with a perforation degree of approximately 60% to 70%, whereby the anode 10 of the FIG. 1 comprises rectangular-shaped perforation openings, the anode 11 of the FIG. 2 comprises rhombus-shaped perforation openings, and the anode 12 of the FIG. 3 comprises circular-shaped perforation openings. The opening size of the perforation openings of the anode according to FIGS. 1 to 3 amounts to approximately 4 to 5 mm.

Figure 4:
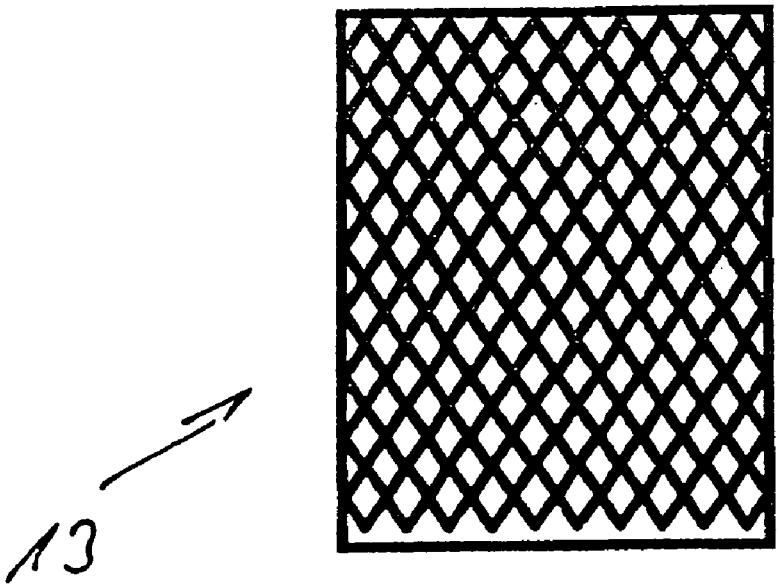
FIG. 4 a strongly schematized illustration of an inventive anode according to a fourth example embodiment for use in the inventive method.
Figure 5:
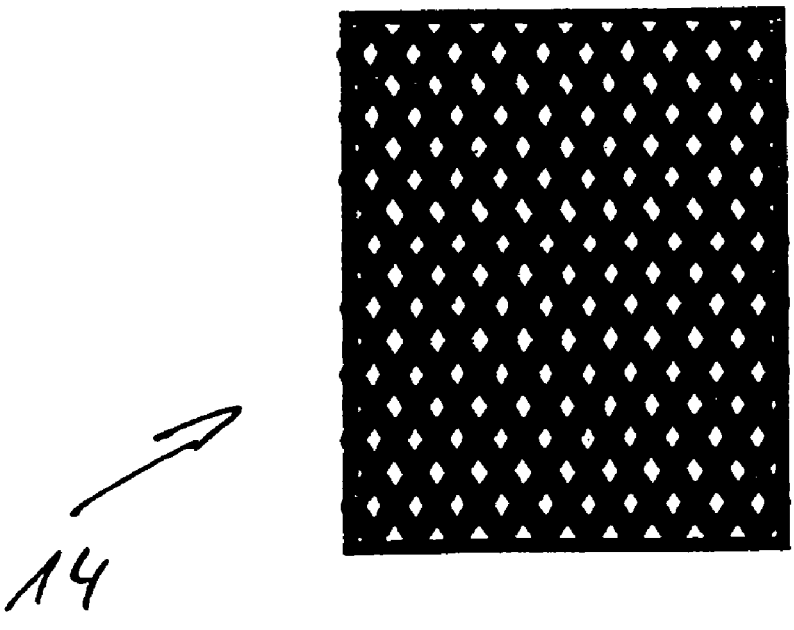
FIG. 5 a strongly schematized illustration of an inventive anode according to a fifth example embodiment for use in the inventive method.

The example embodiments of the FIGS. 4 and 5 show two anodes 13 and 14 with rhombus-shaped perforation openings, whereby the perforation degree of the anode 13 according to FIG. 4 amounts to approximately 70% with an opening size of the perforation openings of approximately 8 mm, and the perforation degree of the anode 14 according to FIG. 5 amounts to approximately 20% with an opening size of the perforation openings of approximately 1 mm.

Due to the open-celled or open-mesh or porous embodied anodes and the relative motion between the galvanic bath on the one hand and the substrate as well as the or each anode on the other hand, a local reduction or depletion of depositable ions is reduced or avoided. The flow or current is essentially not at all hindered by the open-celled or open-mesh or porous anodes. At this point it is pointed out that either the galvanic bath or the substrate to be coated together with the anodes is maintained in motion. In the case in which the galvanic bath is maintained in motion, a corresponding flow can be provided, for example by a pump, which then moves the liquid of the galvanic bath in the laminar flow region with a velocity of preferably 0.1 to 5 cm/s. Alternatively, it is also possible to move the substrate to be coated together with the anode, whereby then a reversing motion must be realized after a motion distance of 0.5 to 20 cm depending on the dimensioning of the galvanic bath.

Figure 6:
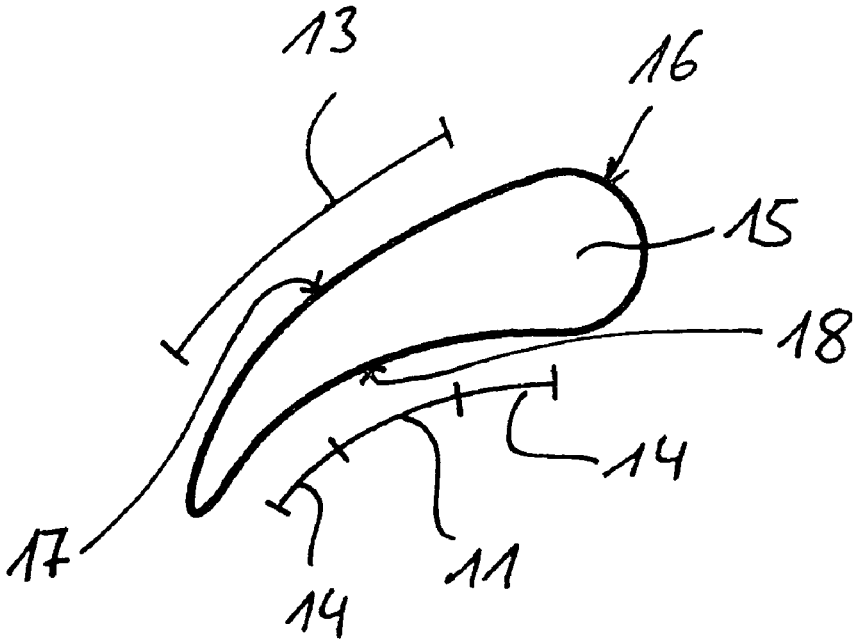
FIG. 6 a strongly schematized illustration of a vane blade profile to be coated, with several utilized anodes according to an invention.

For coating a vane blade profile of a gas turbine vane or blade with the aid of the anodes 10 to 14 illustrated in FIGS. 1 to 5, one preferably proceeds as illustrated in FIG. 6. Thus, in a strongly schematized manner, FIG. 6 shows a profile of a vane blade 15, whereby the vane blade 15 comprises a surface 16 with a convex camber or curvature side 17 and a concave camber or curvature side 18. In the example embodiment of the FIG. 1, an anode with a perforation degree of preferably 70%, preferably the anode 13 of the FIG. 4, is used in the area of the convex curvature side 17 of the vane blade profile. In that regard, the anode 13 preferably has a contour that is adapted or fitted to the contour of the convex curvature side of the vane blade 15 in such a manner so that a uniform spacing distance of approximately 10 to 20 mm is maintained between the convex curvature side 17 of the surface 16 and the anode 13, and that the anode 13, while maintaining this spacing distance, extends over a section of the surface of the substrate that amounts to approximately 70% of the chord length of the convex curvature side 17 in the example embodiment of the FIG. 6.

In the example embodiment of the FIG. 6, a total of three anodes are utilized on the concave curvature side 18 of the vane blade profile, namely two anodes with a perforation degree of approximately 20% and one anode with a perforation degree of approximately 50%, whereby the anodes with the perforation degree of approximately 20% are preferably the anode 14 of the FIG. 5, and the anode with the perforation degree of approximately 50% is preferably the anode 11 of the FIG. 2. As can be seen from FIG. 6, the anode 11 with the perforation degree of approximately 50% is positioned between the two anodes 14 with a perforation degree of approximately 20%. The anodes 11 and 14 on the concave curvature side 18 are also contoured similarly like the anode 13 on the convex curvature side 17 in such a manner so that a uniform spacing distance of approximately 10 to 20 mm is maintained between the anodes 11 and 14 and the concave curvature side 18 of the surface 16 of the substrate 15. On the concave curvature side 18, the anodes 11 and 14 extend with a uniform spacing distance along the surface 16 of the vane blade profile 15 in such a manner so that this spacing distance amounts to approximately 80% of the chord length of the concave curvature region.

It is thus within the sense of the present invention, to use anodes with different perforation degrees and, as the case may be, differently configured perforation openings, for the galvanic deposition of at least one metal of the platinum group or corresponding alloy. In that regard, anodes with different perforation degrees are used on the concave as well as the convex curvature side of the substrate that is to be coated. Furthermore, the galvanic bath is maintained in motion.

Figure 7:
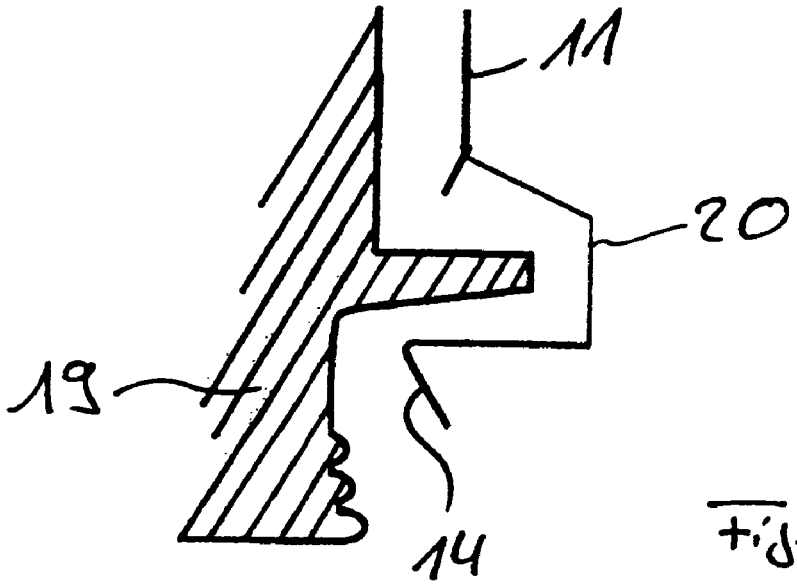
FIG. 7 a strongly schematized illustration of a vane pedestal or root profile to be coated, with several utilized anodes according to the invention.

FIG. 7 shows a further example embodiment of the inventive method, whereby in the example embodiment of the FIG. 7, a gas turbine vane is galvanically coated in the area or region of a vane root or pedestal 19. Thus, FIG. 7 schematically shows the arrangement of the anodes for the homogeneous galvanic deposition of at least one metal of the platinum group or a corresponding alloy in the area of concave undercuts of the vane pedestal 19 of the illustrated gas turbine vane. Here an anode with a perforation degree of approximately 20% is preferably used, for example as it is illustrated in FIG. 5. It is also possible to use an anode with a perforation degree of approximately 50%, as it is illustrated in FIGS. 1 to 3.

In the example embodiment of the FIG. 7, one shall concretely begin from the starting point that an anode with a perforation degree of 20%, thus for example the anode 14 of the FIG. 5, is used in the area of the vane root or pedestal 19, and an anode with a perforation degree of approximately 50%, for example the anode 11 of the FIG. 2, is used in the transition area to a vane blade. In the example embodiment of the FIG. 7, the two anodes 11 and 14 are connected with one another through an insulating holding strap 20. In that regard, the anode 14 used in the pedestal region has a radius that is smaller by the factor of 1.5 to 4 than the radius of the vane pedestal curvature. In the sense of the present invention, the spacing distance between the or each anode and the substrate surface is maintained smaller in curved sections of the substrate surface than in relatively flat or planar surface regions of the substrate. In that regard, the spacing distance of the anodes from the substrate surface in curved surface regions amounts to approximately 40% to 90% of the spacing distance of the anodes in the relatively flat or planar surface regions of the substrate.

In the sense of the present invention, preferably several substrates are coated simultaneously in a galvanic bath with the or each metal of the platinum group or a corresponding alloy. Thereby, a rational production of relatively large piece counts or numbers of parts is possible in the batch process. Moreover, a uniform deposition of platinum and/or palladium or a corresponding alloy onto substrates with a complex three-dimensional geometry is possible with the inventive method.

The invention claimed is:

1. Method for production of a corrosion resistant and/or oxidation resistant coating, comprising:

depositing by galvanizing at least one metal of the platinum group, or an alloy based on at least one metal of the platinum group, on a surface of a substrate, and thereafter carrying out an aluminizing of the thusly galvanically coated substrate, wherein the galvanic deposition of the or each metal of the platinum group or the corresponding alloy is carried out in an at least two-staged deposition process, whereby in a first stage of the deposition process a current magnitude applied for the galvanizing is increased continuously or step-wise beginning from an initial value up to a maximum value, and whereby in a second stage of the deposition process the current magnitude applied for the galvanizing is maintained constant at the maximum value.

2. Method according to claim 1, wherein the galvanic deposition process is carried out over a total coating time T, whereby the first stage of the deposition process occurs in a coating time $T_1$ and the second stage of the deposition process occurs in a coating time $T_2$, whereby the coating time $T_1$ of the first stage amounts to approximately 50% of the total coating time T and the coating time $T_2$ of the second stage amounts to approximately 50% of the total coating time T, and whereby $T=T_1+T_2$.

3. Method according to claim 1, wherein the initial value of the current magnitude applied in the first stage corresponds to approximately 10 to 20% of the maximum value.

4. Method according claim 1, wherein, beginning from the initial value of the current magnitude, in the coating time $T_1$ of the first stage, the current magnitude is continuously increased up to the maximum value.

5. Method according to claim 1, wherein, beginning from the initial value of the current magnitude, the current magnitude is increased step-wise up to the maximum value in the coating time $T_1$ of the first stage.

6. Method according to claim 1, wherein the substrate being coated is cathodically or negatively circuit-connected during the entire galvanic deposition process.

7. Method according to claim 1, wherein, before the deposition process, the substrate to be coated is anodically or positively circuit-connected and thusly introduced into a galvanic bath.

8. Method according to claim 1, wherein, before the deposition process the substrate to be coated is subjected to a surface pre-treatment, comprising:

a) the surface of the substrate to be coated is jet blasted;

b) next the jet-blasted surface is electrochemically cleaned or degreased;

c) next the cleaned or degreased surface is activated.

9. Method according to claim 8, wherein:

a) the surface of the substrate to be coated is jet-blasted with $Al_2O_3$ particles that comprise a particle diameter of 100 to 200 μm, at a pressure of 1.5 to 3.5 bar;

b) next the jet-blasted surface is electrochemically cleaned or degreased in a NaOH solution;

c) next the cleaned or degreased surface is activated in a 40 to 60 volume % HCl solution.

10. Method according to claim 1, wherein the galvanic deposition of the or each metal of the platinum group or the corresponding alloy is carried out while using at least one open-celled or open-mesh or porous anode, and that a relative motion is established between on the one hand a galvanic bath and on the other hand the substrate as well as the or each open-celled or open-mesh or porous anode during the galvanic deposition.

11. Method according to claim 10, wherein the or each open-celled or open-mesh or porous anode comprises rectangular-shaped and/or rhombus-shaped and/or circular-shaped perforation openings with a perforation degree between 20% and 80%.

12. Method according to claim 11, wherein the perforation openings comprise an opening size between 1 and 10 mm.

13. Method according to claim 10, wherein several open-celled or open-mesh or porous anodes are used for the coating of a vane blade profile of a gas turbine vane, whereby at least one anode with a perforation degree of approximately 80% is used on a convex curvature side of the vane blade profile, and whereby at least one anode with a perforation degree of approximately 20% and at least one anode with a perforation degree of approximately 50% are used on a concave curvature side of the vane blade profile.

14. Method according to claim 13, wherein the contours of each anode are adapted to the surface of the vane blade profile to be coated in such a manner so that a uniform spacing distance between 10 and 20 mm is maintained between the surface of the substrate to be coated and each anode, whereby each anode while maintaining the above spacing distance extends over a section of the surface of the substrate that amounts to between 40% and 80% of the chord length of the respective curvature side of the substrate.

15. Method according to claim 1, wherein the metal of the platinum group is platinum.

16. Method according to claim 1, wherein the metal of the platinum group is palladium.

* * * * *